US006868696B2

(12) United States Patent
Ikuta

(10) Patent No.: US 6,868,696 B2
(45) Date of Patent: Mar. 22, 2005

(54) EVAPORATOR

(75) Inventor: Shiro Ikuta, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/826,900

(22) Filed: Apr. 16, 2004

(65) Prior Publication Data

US 2004/0206488 A1 Oct. 21, 2004

(30) Foreign Application Priority Data

Apr. 18, 2003 (JP) ..... P2003-114217

(51) Int. Cl.[7] ..... F25B 39/02

(52) U.S. Cl. ..... 62/515; 165/152; 165/153; 165/174; 165/176

(58) Field of Search ..... 62/515, 516, 517, 62/518; 165/152, 153, 147, 176, DIG. 466

(56) References Cited

U.S. PATENT DOCUMENTS 4,723,601 A * 2/1988 Ohara et al. ..... 165/153
4,915,163 A * 4/1990 Matsunaga et al. ..... 165/153
5,137,082 A * 8/1992 Shimoya et al. ..... 165/110
5,172,759 A * 12/1992 Shimoya et al. ..... 165/110
5,211,222 A * 5/1993 Shinmura ..... 165/176
5,409,056 A * 4/1995 Farry et al. ..... 165/153
5,669,439 A * 9/1997 Hasegawa et al. ..... 165/153
5,855,240 A * 1/1999 Farrell et al. ..... 165/76
5,881,805 A * 3/1999 Inoue et al. ..... 165/153
5,896,916 A * 4/1999 Baechner et al. ..... 165/78
5,909,766 A * 6/1999 Kobayashi et al. ..... 165/70
5,930,894 A * 8/1999 Oikawa et al. ..... 29/890.047
6,241,011 B1 * 6/2001 Nakamura et al. ..... 165/153

FOREIGN PATENT DOCUMENTS

JP 403230064 A * 10/1991
JP 404324078 A * 11/1992
JP 08-110123 4/1996
JP 08271091 A * 10/1996

* cited by examiner

*Primary Examiner*—William E. Tapolcai
*Assistant Examiner*—Mohammad M. Ali
(74) *Attorney, Agent, or Firm*—Brenda O. Holmes; Kilpatrick Stockton LLP

(57) ABSTRACT

An evaporator includes a plurality of laminated tubes, each of which is provided therein with a refrigerant passage, an inlet header chamber which is in communication with one end of the refrigerant passage, and an outlet header chamber which is in communication with the other end of the refrigerant passage. The inlet header chamber is located above the refrigerant passage. The inlet header chamber is partitioned by a partition wall into an inner header chamber and an outer header chamber which is disposed around the inner header chamber and which is in communication with the refrigerant passage. The inner header chambers of the adjacent tubes are in communication with each other. An assembly of the inner header chambers forms a header inlet tank chamber. The partition wall is provided with refrigerant holes located above a lowermost point a of the inner header chamber and at different levels.

13 Claims, 14 Drawing Sheets

2
16
18c
18b
18a
H
A
11
14
15
10
10a
D

EVAPORATOR

BACKGROUND OF THE INVENTION

The present invention relates to an evaporator in which a header inlet tank chamber and a header outlet tank chamber are integrally formed together by a plurality of laminated tubes.

FIGS. 1 to 3 show a conventional evaporator of this kind. As shown in FIGS. 1 and 2, an evaporator 100 mainly includes laminated tubes 101, corrugated fins 102 each disposed between the adjacent tubes 101, a refrigerant inlet pipe 103 connected to one end side of the laminated tubes 101, and a refrigerant outlet pipe 104 connected to the other end side of the laminated tubes 101.

Each tube 101 includes a pair of tube plates 101*a* and 101*a* which are opposed to and connected to each other. As shown in FIG. 3, the tube 101 is provided therein with a U-shaped refrigerant passage 110, an inlet header chamber 111 which is in communication with one end of the refrigerant passage 110, and an outlet header chamber 112 which is in communication with the other end of the refrigerant passage 110. The inlet header chambers 111 of the adjacent tubes 101 are in communication with each other through a communication hole 113. An assembly of the inlet header chambers 111 forms a header inlet tank chamber 114. The refrigerant inlet pipe 103 is connected to the header inlet tank chamber 114.

As shown in FIG. 3, the outlet header chambers 112 of the adjacent tubes 101 are in communication with each other through a communication hole 115. An assembly of the outlet header chambers 112 forms a header outlet tank chamber 116. The refrigerant outlet pipe 104 is connected to the header outlet tank chamber 116.

As shown in FIG. 3, a pair of left and right arc refrigerant holding projections is provided at a boundary between the inlet header chamber 111 and the refrigerant passage 110. Semi-arc refrigerant storing spaces 118 are formed on the refrigerant holding projections 117. Refrigerant which flows into the inlet header chamber 111 is temporarily stored in the refrigerant storing space 118. A first communication passage 119 is formed between lowermost ends of the pair of refrigerant holding projections 117. An uppermost end of one of the refrigerant holding projections 117 is connected to a plate edge 120, and a second communication passage 121 is formed between the plate edge 120 and an uppermost end of the other refrigerant holding projection 117. A pair of refrigerant holding projections 117 is similarly formed at the boundary between the outlet header chamber 112 and the refrigerant passage 110. The same elements are designated with the same symbols, and explanation thereof will be omitted.

Flow of refrigerant in the evaporator 100 will be explained. Refrigerant which flows from the refrigerant inlet pipe 103 flows into the header inlet tank chamber 114, and flows into the refrigerant passage 110 from the inlet header chamber 111 of each tube 101. Then, the refrigerant flows along the U-shaped passage, during which process, the refrigerant exchanges heat with fluid existing outside. The refrigerant flowing through the refrigerant passage 110 flows into the header outlet tank chamber 116 from the outlet header chamber 112 of each tube 101, and merges with another refrigerant which has circulated through another refrigerant passage 110 of another tube 101 and then flows out from the refrigerant outlet pipe 104.

During this flowing process of the refrigerant, liquid phase refrigerant which enters into each inlet header chamber 111 enters the refrigerant storing space 118 on the refrigerant holding projection 117. The liquid phase refrigerant which has entered the refrigerant storing space 118 drops into the refrigerant passage 110 from the lowermost first communication passage 119. If the flowing amount is greater than the dropping amount, the liquid phase refrigerant is gradually stored therein. If the liquid phase refrigerant in the refrigerant storing space 118 overflows, the liquid phase refrigerant drops into the refrigerant passage 110 from the second communication passage 121. Gas phase refrigerant which has entered into the inlet header chamber 111 flows into the refrigerant passage 110 from the second communication passage 121.

Therefore, when an amount of flowing refrigerant is enough and liquid phase refrigerant always overflows from the refrigerant storing space 118 of each tube 101, the refrigerant is distributed to the refrigerant passages 110 of the tubes 101 substantially equally.

SUMMARY OF THE INVENTION

However, when the amount of flowing refrigerant is insufficient and the liquid phase refrigerant does not overflow from the refrigerant storing space 118 of each tube 101, the liquid phase refrigerant is not distributed to the refrigerant passages 110 of the tubes 101 equally. That is, in the conventional heat exchanger 100, when the amount of flowing refrigerant is equal to or greater than a given value, the refrigerant can be distributed equally, but when the flow rate of the refrigerant is small, the refrigerant is not distributed equally, and there is a problem that the heat exchanging efficiency is deteriorated.

When the flow rate of the refrigerant is more than a given value and the liquid phase refrigerant flows into the refrigerant passage 110 from the second communication passage 121 by overflow, the gas phase refrigerant flows into the refrigerant passage 110 from the second communication passage 121 together with the liquid phase refrigerant. If the liquid phase refrigerant and gas phase refrigerant are simultaneously injected from the same hole, the liquid phase refrigerant is greatly affected by dynamic pressure of the gas phase refrigerant and is discharged from the second communication passage 121. Therefore, the liquid phase refrigerant is not distributed to the refrigerant passages 110 equally. That is, even when the flow rate of refrigerant is sufficient, the distributing ratio of the liquid phase refrigerant and the gas phase refrigerant becomes uneven, and there is a problem that the heat exchanging efficiency is deteriorated.

The present invention has been accomplished to solve the above problems, and the invention provides an evaporator that can substantially equally distribute refrigerant to refrigerant passages irrespective of the flow rate of the refrigerant, and can enhance the heat exchanging efficiency.

According to a first technical aspect of the present invention, the evaporator has a plurality of laminated tubes, a refrigerant passage formed in each tube, an inlet header chamber which is in communication with one end of the refrigerant passage, and an outlet header chamber which is in communication with the other end of the refrigerant passage. The evaporator includes an inner header chamber defined in the inlet header chamber by a partition wall, an outer header chamber defined by an outer periphery of the inner header chamber by the partition wall, the outer header chamber being in communication with the refrigerant passage, and a common refrigerant supplier formed by an assembly of the inner header chambers. The refrigerant supplier stores refrigerant having substantially the same liquid level in all the inner header chambers.

According to a second technical aspect of the invention, the evaporator further includes a plurality of refrigerant through holes formed in the partition wall. The refrigerant through holes are formed at least at two levels with respect to the liquid level. Refrigerant which flows out from the refrigerant supplier is supplied to the refrigerant passages through the outer header chambers.

BRIEF DESCRIPTION OF THE DRAWINGS

FIGS. 16A to 16C show a modification of the first embodiment of the invention, wherein FIG. 16A shows an inner surface of an essential portion of a tube which is inclined at an angle of −20°, FIG. 16B shows the inner surface of an essential portion of the tube which is inclined at an angle of 0°, and FIG. 16C shows the inner surface of an essential portion of the tube which is inclined at an angle of +20°.

DESCRIPTION OF THE PREFERRED EMBODIMENTS

Embodiments of the present invention are explained below with reference to the accompanying drawings.

First Embodiment

Figure 1:
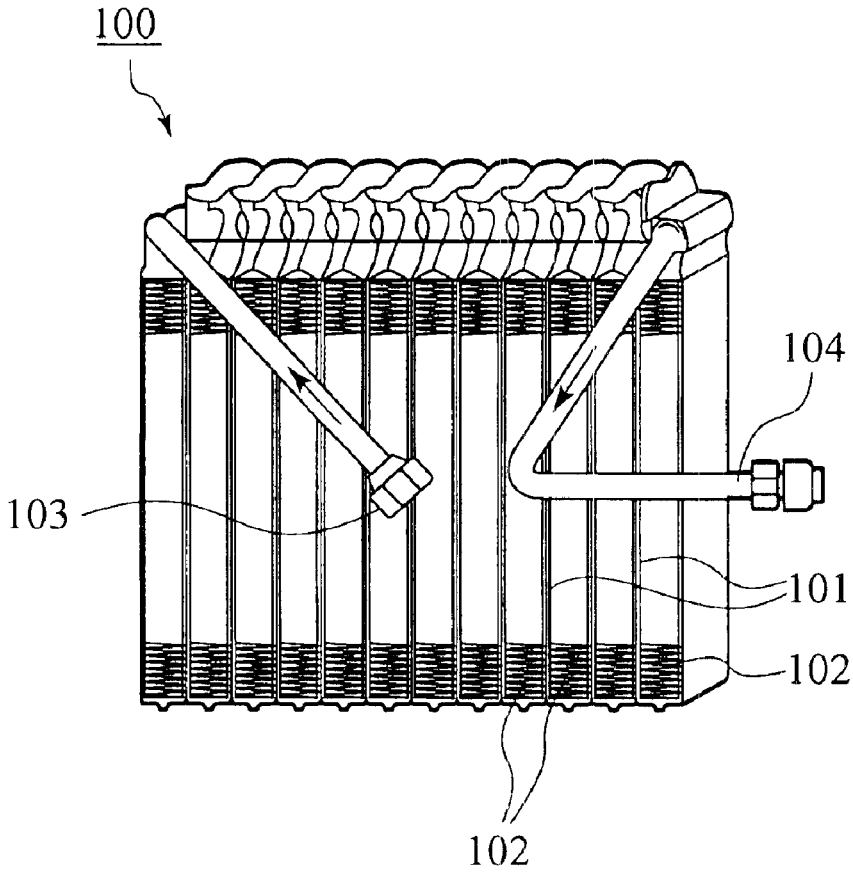
FIG. 1 is a perspective view of a conventional heat exchanger.
Figure 2:
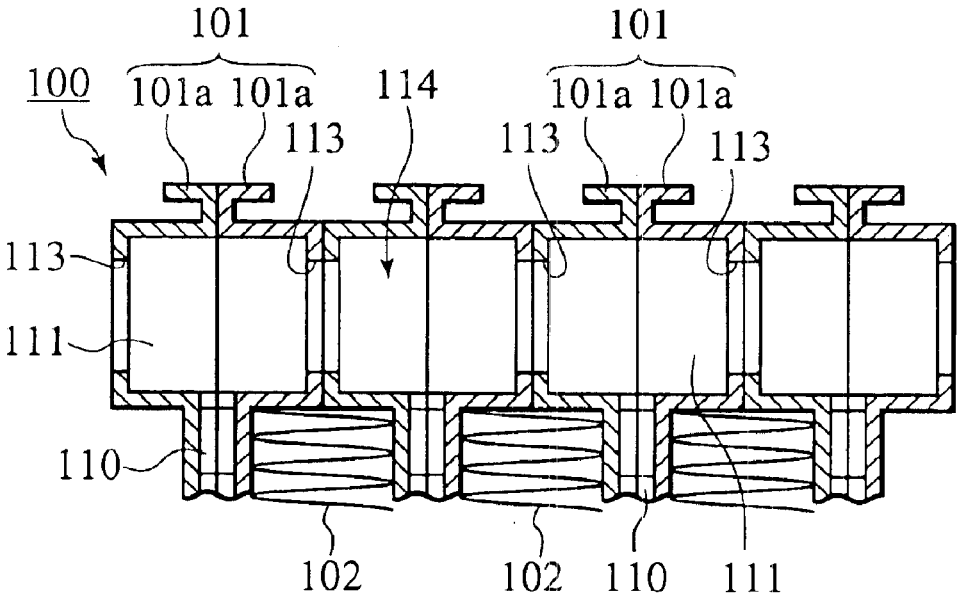
FIG. 2 is a sectional view of an essential portion of a conventional evaporator.
Figure 3:
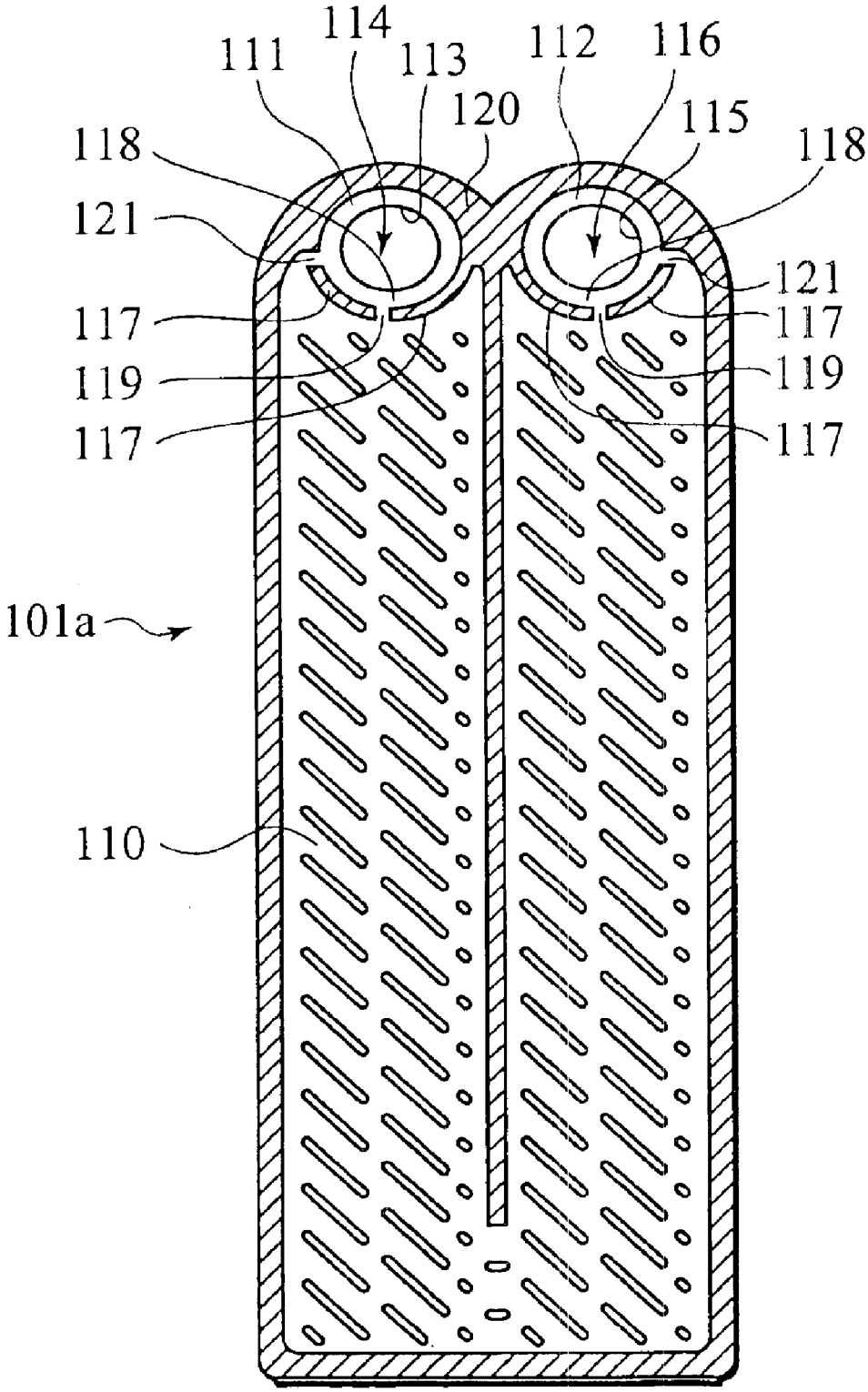
FIG. 3 shows an inner surface of a conventional tube plate.
Figure 4:
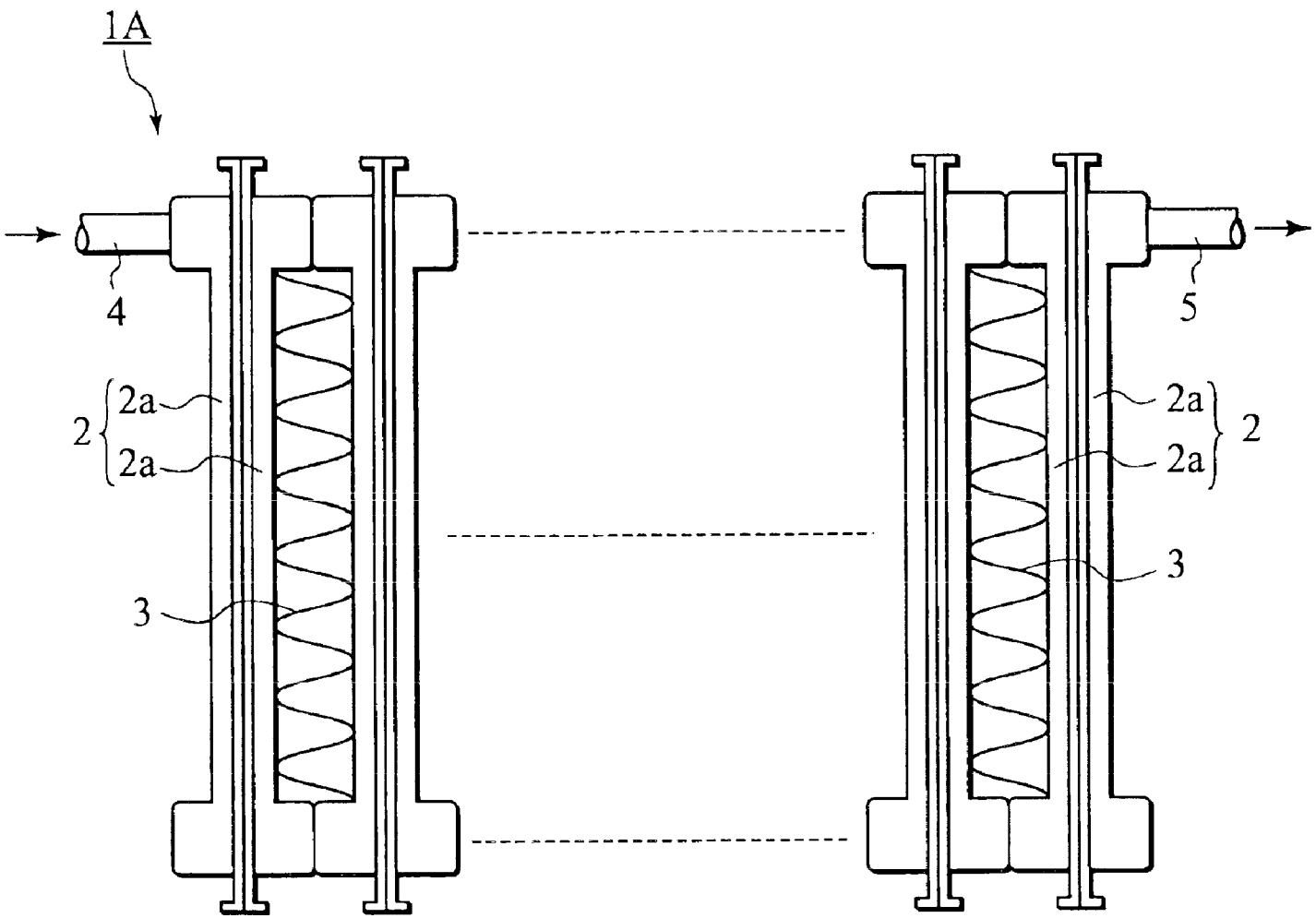
FIG. 4 is a front view of an evaporator of a first embodiment of the present invention.
Figure 5:
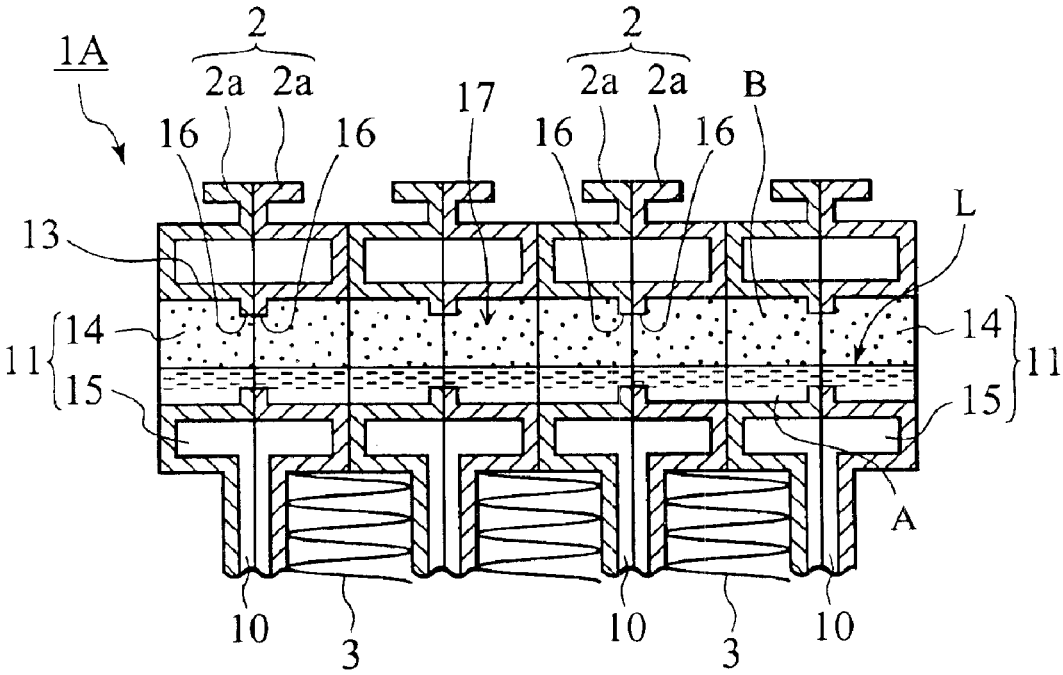
FIG. 5 is a sectional view of an essential portion of the evaporator according to the first embodiment of the invention.
Figure 6:
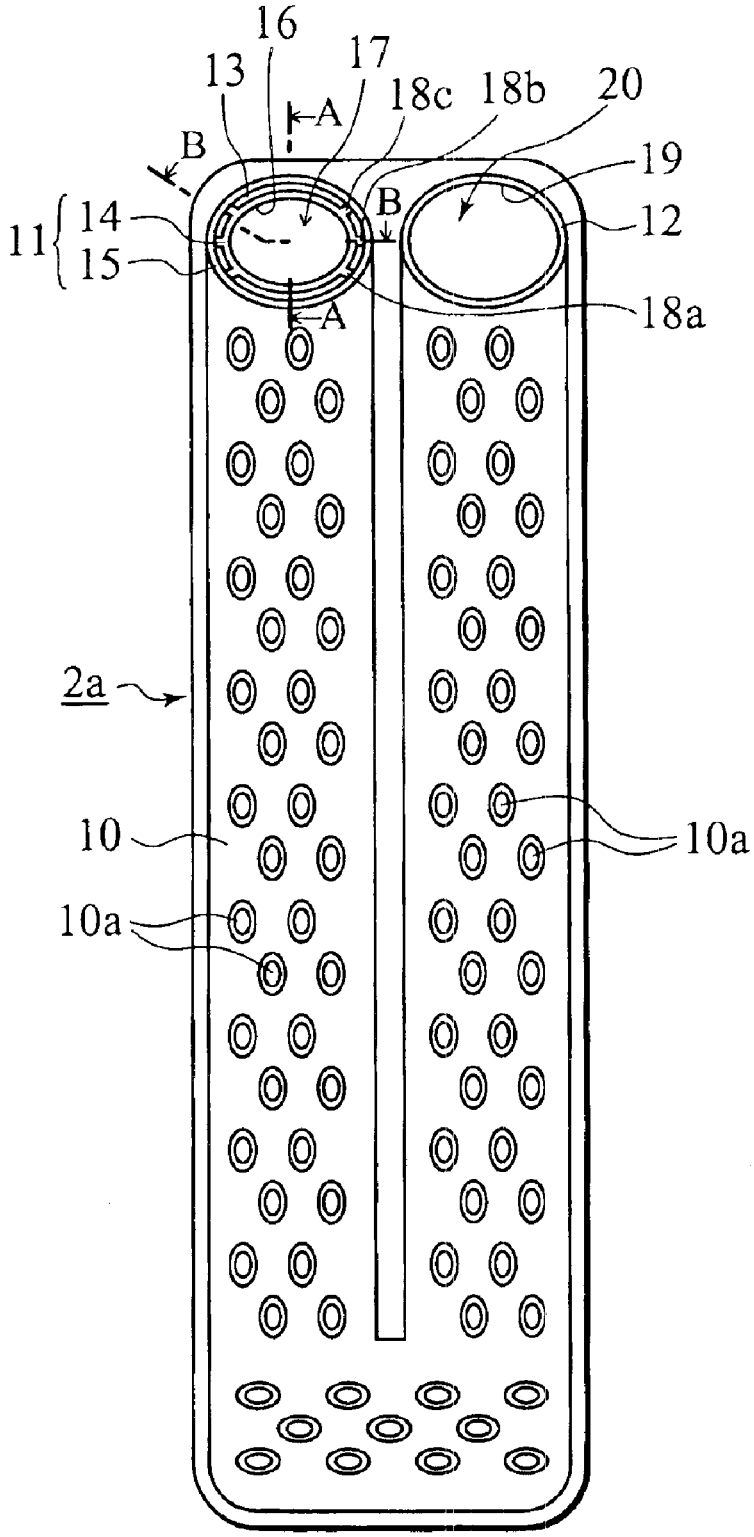
FIG. 6 shows an inner surface of a tube plate according to the first embodiment of the invention.
Figure 7:
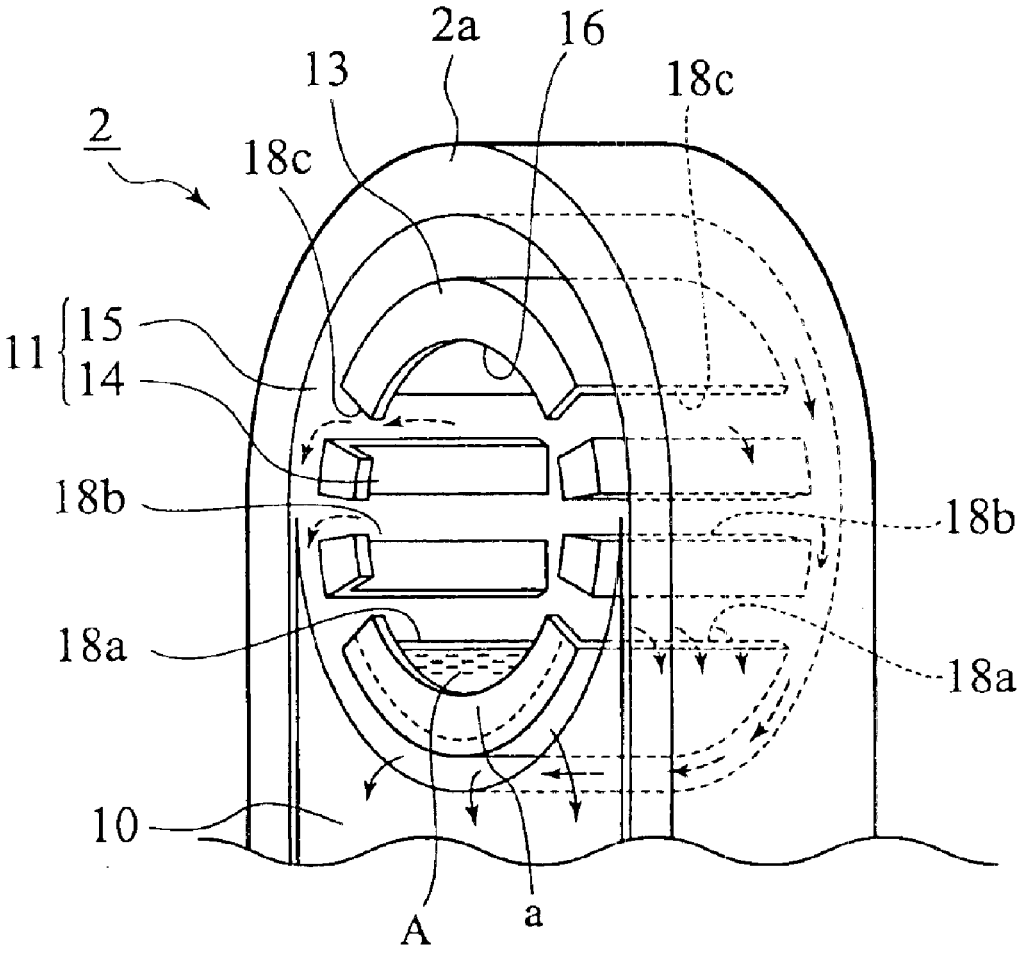
FIG. 7 is a magnified perspective view of an inlet header chamber of the tube plate according to the first embodiment of the invention.
Figure 8:
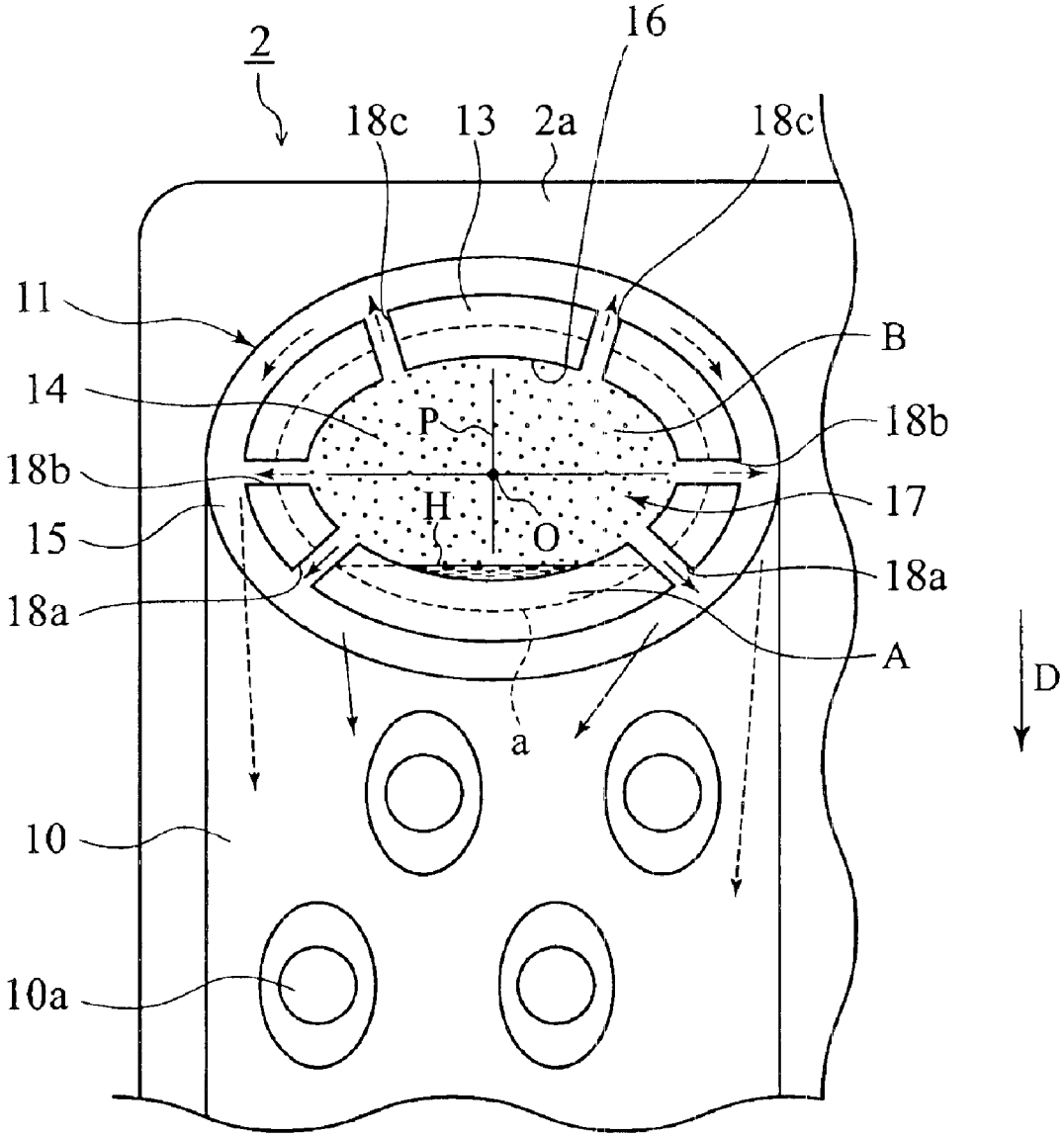
FIG. 8 is a magnified view of an inner surface of the inlet header chamber of the tube plate according to the first embodiment of the invention.
Figure 9:
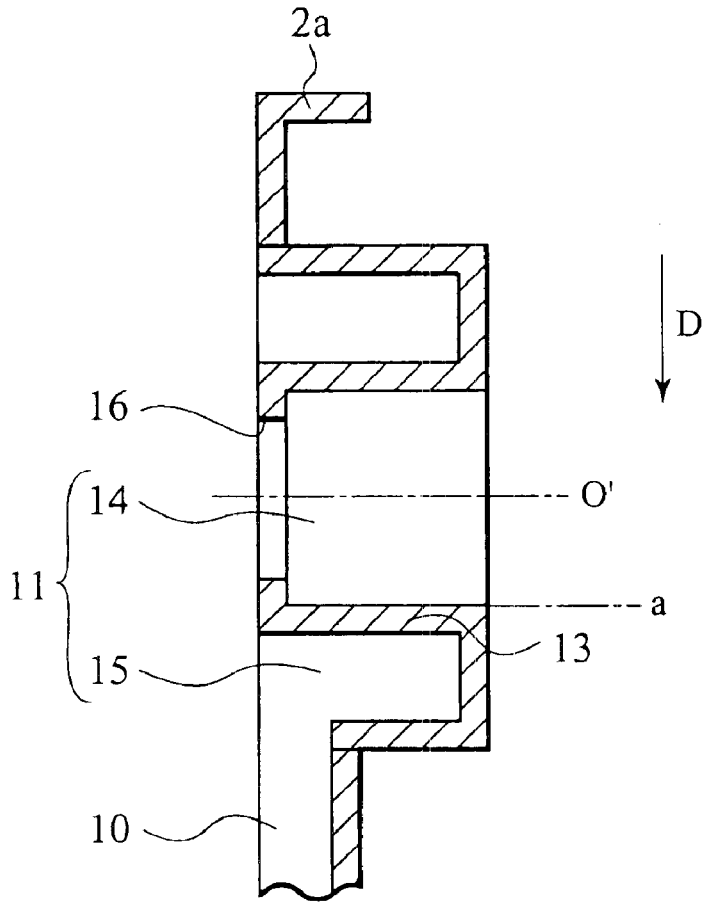
FIG. 9 is a sectional view taken along a line IX—IX in FIG. 6 showing the first embodiment of the invention.
Figure 10:
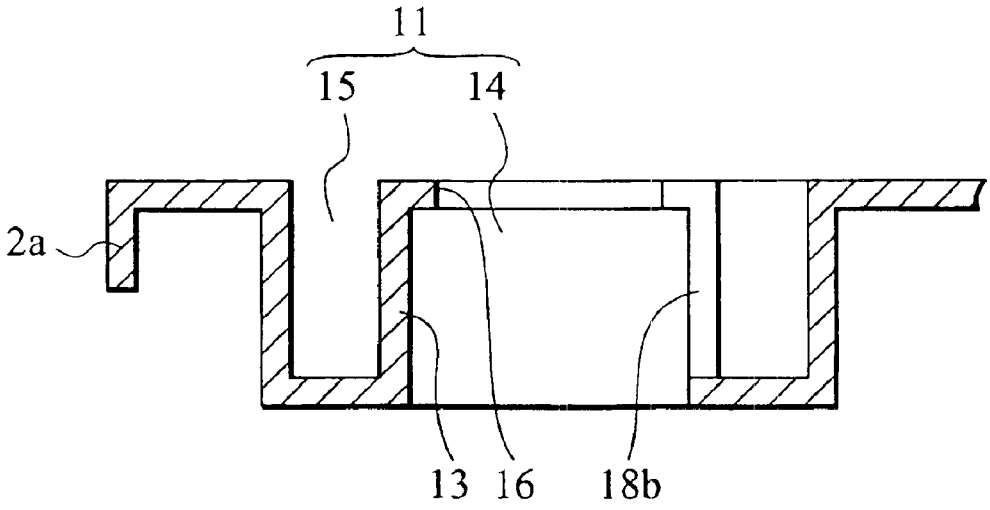
FIG. 10 is a sectional view taken along a line X—X in FIG. 6 showing the first embodiment of the invention.

FIGS. 4 to 11 show a first embodiment of the present invention. FIG. 4 is a front view of an evaporator 1A, FIG. 5 is a sectional view of an essential portion of the evaporator 1A, FIG. 6 shows an inner surface of a tube plate 2*a*, FIG. 7 is a magnified perspective view of an inlet header chamber 11 of the tube plate 2*a*, FIG. 8 is a magnified view of an inner surface of the inlet header chamber 11 of the tube plate 2*a*, FIG. 9 is a sectional view taken along a line IX—IX in FIG. 6, FIG. 10 is a sectional view taken along a line X—X in FIG. 6, and FIGS. 11(*a*) to 11(*d*) show steps for explaining a forming procedure of the inlet header chamber 11.

As shown in FIGS. 4 and 5, the evaporator 1A mainly includes laminated tubes 2, corrugated fins 3 disposed between adjacent tubes 2, a refrigerant inlet pipe 4 connected to one of outermost ends of the laminated tubes 2, and a refrigerant outlet pipe 5 connected to the other outermost end of the laminated tubes 2.

Each tube 2 includes a pair of tube plates 2*a* and 2*a* which are opposed to and connected to each other. As shown in FIG. 6, the tube 2 is formed therein with a U-shaped refrigerant passage 10, an inlet header chamber 11 which is in communication with one end of the refrigerant passage 10, and an outlet header chamber 12 which is in communication with the other end of the refrigerant passage 10. The inlet header chamber 11 and the outlet header chamber 12 are located above the refrigerant passage 10. A large number of projections 10a are disposed in position in the tube 2.

As shown in FIGS. 7 to 10, the inlet header chamber 11 is partitioned by a partition wall 13 which projects in a substantially elliptic cylindrical shape, into inside inner header chambers 14 and outer header chambers 15 located at outer periphery of the inner header chambers 14. That is, the inner header chamber 14 is defined by the partition wall 13, and the outer header chamber 15 is defined outside the inner header chamber 14. The inner header chambers 14 between the butted tube plates 2*a* are opened through communication holes 16, and the inner header chambers 14 of the adjacent tubes 2 are in communication with each other. As shown in FIG. 5, an assembly of the inner header chambers 14 forms a header inlet tank chamber 17. The refrigerant inlet pipe 4 is connected to the header inlet tank chamber 17. The header inlet tank chamber 17 can store a given amount of refrigerant in its lower portion and thus, the header inlet tank chamber 17 functions as a refrigerant supplier, commonly used for by the tubes 2. As will be described later, the header inlet tank chamber 17 can store refrigerant having substantially the same liquid level L in all the inner header chambers 14.

The outer header chamber 15 is formed over the entire periphery of the inner header chamber 14, and a lower portion of the outer header chamber 15 is in communication with the refrigerant passage 10. Each partition wall 13 is provided at its three height positions with refrigerant through holes 18*a*, 18*b* and 18*c* which are laterally symmetric with respect to a center of the partition wall 13. More specifically, as shown in FIGS. 7 and 8, the refrigerant through holes 18*a*, 18*b* and 18*c* are two lower holes 18*a*, two intermediate holes 18*b* and two upper holes 18*c*. Each lower hole 18*a* is located above a lowermost point a in the inner header chamber 14 and lower than a center position O of the inner header chamber 14. Each intermediate hole 18*b* is located at substantially the same level as that of the center position O of the inner header chamber 14. Each upper hole 18*c* is located above the center position O of the inner header chamber 14. The lower hole 18*a* is located such that a cross section area of the inner header chamber 14 lower than a horizontal line H which intersects with the lower holes 18*a* is one-third of the entire cross section area of the inner header chamber 14. Here, the term "low", "lower", or "below" means a direction same as a gravity direction D as depicted by an arrow D in FIG. 8, and the term "high", "upper", or "above" means a direction opposite to the gravity direction D. A vertical (plumb) line P is in parallel to the gravity direction D.

As shown in FIG. 6, the outlet header chamber 12 is formed as a single space having an elliptic section. Each outlet header chamber 12 is opened through a communication hole 19. The adjacent outlet header chambers 12 of the tube 2 are in communication with each other through the communication hole 19. An assembly of the outlet header chambers 12 forms a header outlet tank chamber 20. The refrigerant outlet pipe 5 is connected to the header outlet tank chamber 20.

Flow of refrigerant in the evaporator 1A will be explained next. The refrigerant from the refrigerant inlet pipe 4 flows into the header inlet tank chamber 17, and flows into the refrigerant passage 10 from the inner header chamber 14 of each tube 2 through the through holes 18*a*, 18*b* and 18*c* and the outer header chamber 15. Then, the refrigerant flows through each U-shaped refrigerant passage 10. During this process, the refrigerant exchanges heat with fluid outside the refrigerant passage. The refrigerant flowing through the refrigerant passage 10 then flows into the header outlet tank chamber 20 from the outlet header chamber 12 of each tube 2, and merges with another refrigerant which has circulated through another refrigerant passage 10 of another tube 2, and flows out from the refrigerant outlet pipe 5.

During the passage of the refrigerant, the refrigerant is supplied from the inner header chamber 14 of each tube 2 to the refrigerant passage 10 through the outer header chamber 15. This operation will be explained in detail. In the refrigerant flowing into the inner header chamber 14, a specific gravity of liquid phase refrigerant A is large and a specific gravity of gas phase refrigerant B is relatively small. Thus, as shown in FIG. 5, the liquid phase refrigerant A is stored in an entire lower region of the inner header chamber 14, and the gas phase refrigerant B is stored in the entire upper region of the inner header chamber 14. In this state, if the liquid level of the liquid phase refrigerant A becomes higher than the lower holes 18*a*, the liquid phase refrigerant A overflows and flows out from the lower holes 18*a* of the tube 2. Only when the liquid phase refrigerant A overflows, the liquid phase refrigerant A flows into the outer header chamber 15 and the refrigerant passage 10. Thus, the header inlet tank chamber 17 functions as a refrigerant supplier, commonly used by all the tubes 2. Since refrigerant is always stored in the header inlet tank chamber 17 at a constant level, even if the flow rate of the refrigerant is small, the refrigerant is equally distributed in the common refrigerant supplier, and the liquid phase refrigerant A is equally supplied to the refrigerant passages 10 of the tubes 2.

On the other hand, the gas phase refrigerant B stored in the inner header chamber 14 is allowed to flow out mainly by gas pressure from the intermediate holes 18*b* and the upper holes 18*c* from which the liquid phase refrigerant A does not flow out. Since the intermediate holes 18*b* and the upper holes 18*c* function as filters with respect to the gas flow, the refrigerant is released into the outer header chambers 15 of the tubes 2 substantially equally from the intermediate holes 18*b* and the upper holes 18*c* of the tubes 2. Since the gas phase refrigerant B and the liquid phase refrigerant A are less prone to be mixed with each other and they flow out from different holes, the liquid phase refrigerant A stored in the inner header chamber 14 is discharged almost without being affected by pressure of the gas phase refrigerant B or variation of the pressure. Thus, the refrigerant can be distributed to the refrigerant passages 10 substantially equally irrespective of the flow rate of the refrigerant, and the heat exchange efficiency can be enhanced.

In this embodiment, since the refrigerant through holes 18*a*, 18*b* and 18*c* (lower holes 18*a*, intermediate holes 18*b* and upper holes 18*c*) are located at three levels with respect to the liquid level along a circumference part of the inner header chamber 14, liquid phase refrigerant A flows out mainly from the lower holes 18*a*, and gas phase refrigerant B flows out mainly from the intermediate holes 18*b* and the upper holes 18*c*. Therefore, the liquid phase refrigerant A is hardly affected by flow resistance and pressure variation of the gas phase refrigerant B, and this enhances the uniform distribution of refrigerant to the refrigerant passages 10.

In this embodiment, it is preferable that the lower holes 18*a* are located at such positions that the cross section area of the inner header chamber 14 lower than the horizontal line H which forms point of intersection of the lower holes 18*a* is one-third of the entire cross section area of the inner header chamber 14 or less than that. As a result, since a constant amount (volume) of liquid phase refrigerant A is always stored in the inner header chamber 14, the liquid phase refrigerant A stably flows out by overflow.

In this embodiment, the refrigerant through holes 18*a*, 18*b* and 18*c* are provided laterally symmetrically with respect to the center of the inner header chamber 14. That is, the left and right refrigerant holes are disposed substantially in parallel to the horizontal line H. Therefore, the liquid phase refrigerant A and the gas phase refrigerant B can flow out respectively from the left and right positions of the inner header chamber 14. Thus, the liquid phase refrigerant A and the gas phase refrigerant B can smoothly flow out from the inner header chamber 14. Pressures of the refrigerant in the left and right refrigerant holes in the inner header chamber 14 and the outer header chamber 15 can be prevented from being different from each other.

Figure 11A:
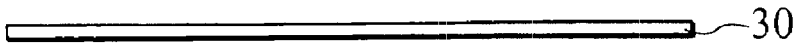
FIGS. 11A, 11B, 11C and 11D show steps for explaining a forming procedure of an inlet header chamber according to the first embodiment of the invention.
Figure 11B:
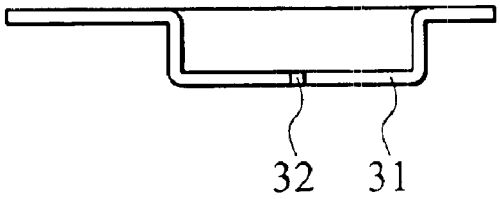

The forming procedure of the inlet header chamber 11 of the tube plate 2*a* will be explained next based on FIGS. 11A to 11D. A flat plate 30 shown in FIG. 11A is subjected to a push-out operation and a punch-out operation. In the push-out operation, as shown in FIG. 11B, a push-out portion 31 corresponding to an outer periphery of the outer header chamber 15 is formed. In the punch-out operation, the push-out portion 31 is formed at its center position with a hole 32.

Figure 11C:
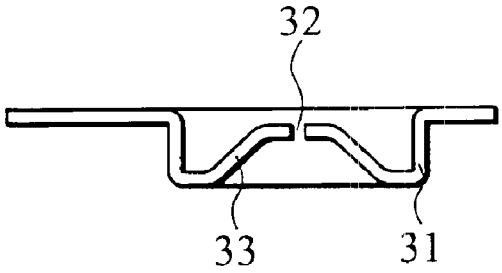

Then, as shown in FIG. 11C, an inner periphery of the push-out portion 31 is formed with a return-inclined wall 33 by a pushing and bending operation.

Figure 11D:
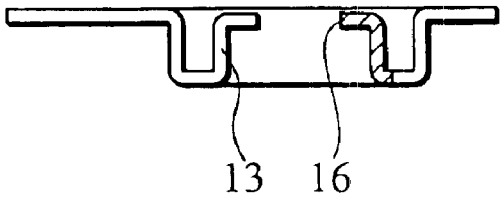

As shown in FIG. 11D, the return-inclined wall 33 is then further pushed and bent to form the partition wall 13 by a bending operation. With this bending operation, the hole 32 is increased in diameter and the communication hole 16 is formed. Lastly, predetermined portions (shown with hatching in the drawing) of the partition wall 13 are cut to form the through holes 18*a*, 18*b* and 18*c* (shown in FIG. 7 and the like).

According to the conventional evaporator, when a pair of refrigerant holding projections is provided at a boundary position between the refrigerant passage 10 and the inlet header chamber 11, there is an adverse possibility that a crack is generated. According to the present invention, since the inlet header chamber 11 is provided therein with the partition wall 13, the refrigerant holding projections can be formed without generating a crack.

According to this embodiment, the liquid phase refrigerant flowing into the inner header chamber is stored in the entire lower region of the inner header chamber, and the gas phase refrigerant is stored in the entire upper region of the inner header chamber. If the liquid level of the liquid phase refrigerant A becomes higher than the lower refrigerant hole, the liquid phase refrigerant flows out from the lower refrigerant hole of the tubes only by the overflow. Therefore, even when the flow rate of the refrigerant is small, the liquid phase refrigerant equally flows out into the refrigerant passages of the tubes. On the other hand, the gas phase refrigerant stored in the inner header chamber is allowed to flow out by gas pressure from the upper refrigerant holes from which the liquid phase refrigerant does not flow out. Therefore, the refrigerant flows out into the refrigerant passages of the tubes substantially equally. Since the gas phase refrigerant flows out basically through a hole different from the liquid phase refrigerant, the liquid phase refrigerant stored in the inner header chamber is discharged almost without being affected by dynamic pressure of the gas phase refrigerant. Thus, it is possible to distribute the refrigerant substantially equally to the refrigerant passages irrespective of the flow rate of the refrigerant, and to enhance the heat exchanging efficiency.

The liquid phase refrigerant flows out mainly from the lower holes and the gas phase refrigerant flows out mainly from the intermediate holes and the upper holes. Therefore, the liquid phase refrigerant is equally distributed to the refrigerant passages almost without being affected by dynamic pressure of the gas phase refrigerant.

Second Embodiment

Figure 12:
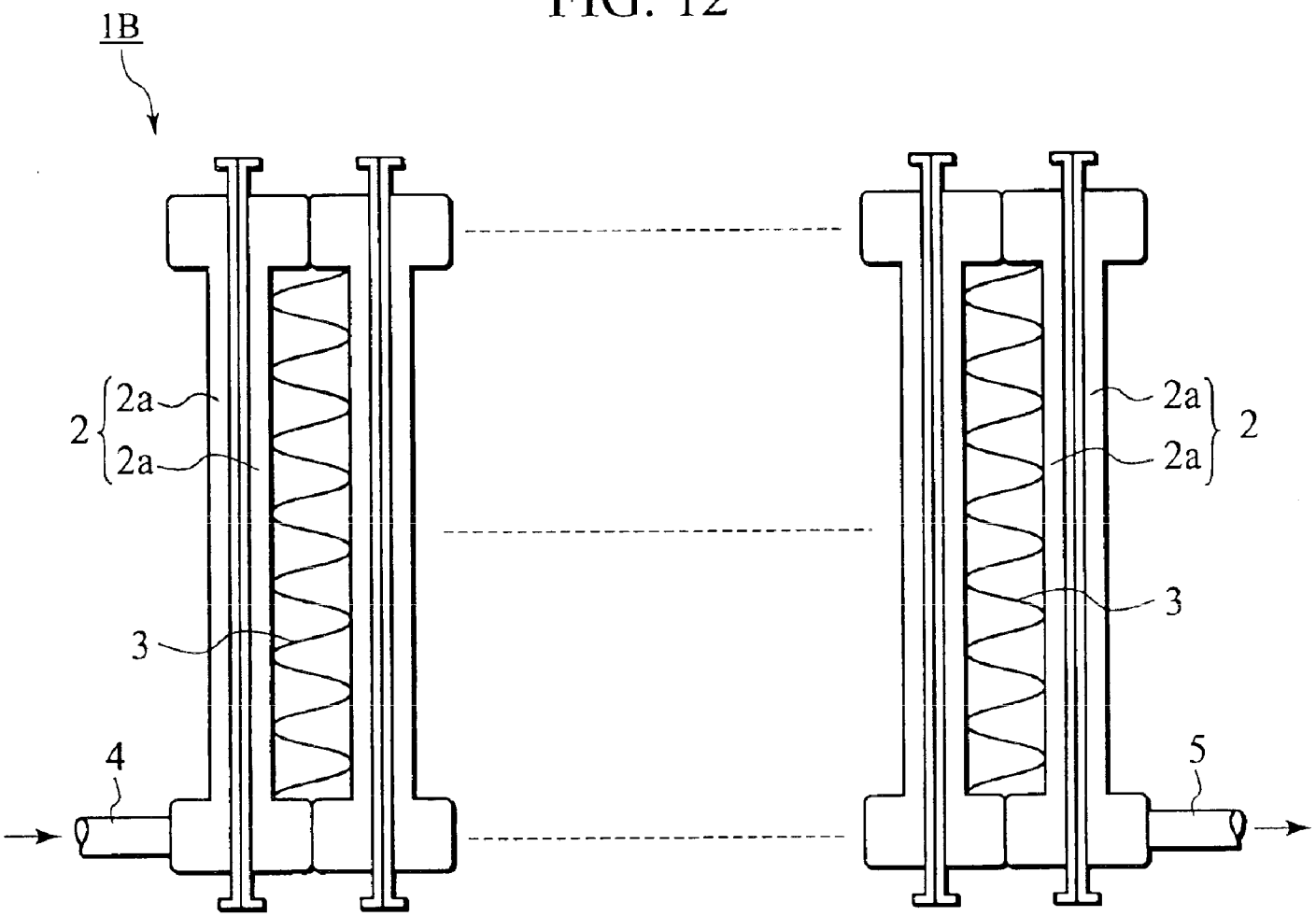
FIG. 12 is a front view of an evaporator according to a second embodiment of the invention.
Figure 13:
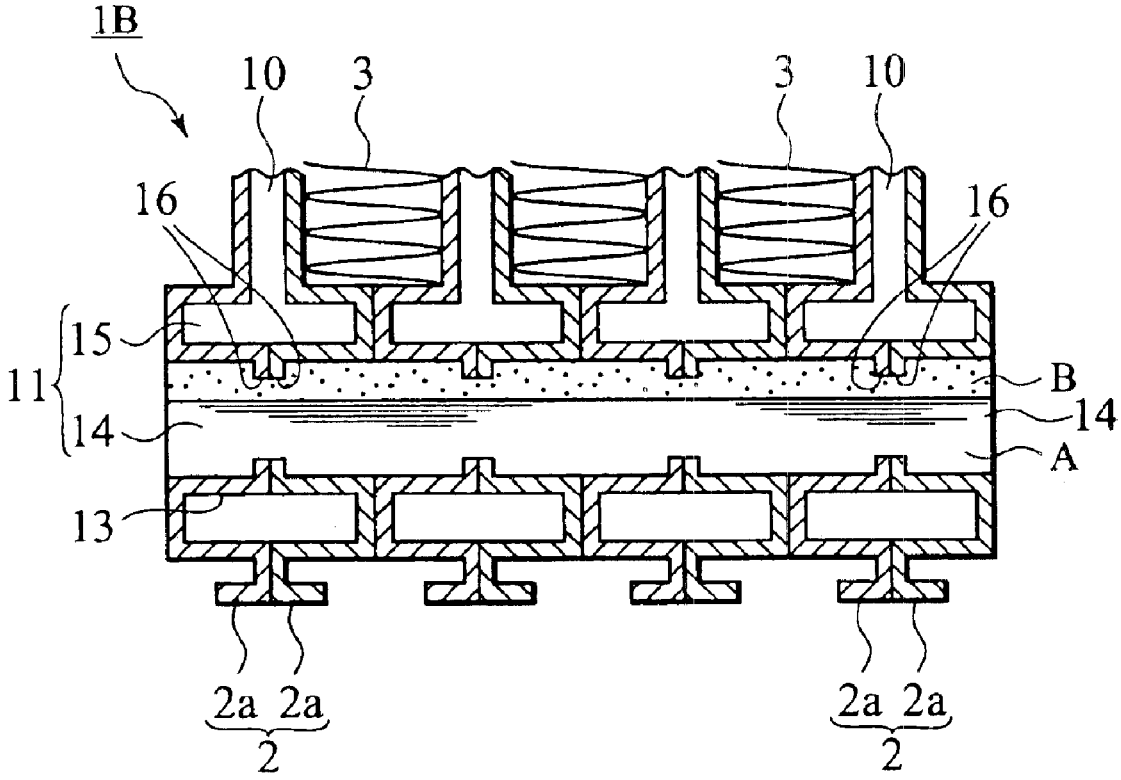
FIG. 13 is a sectional view of an essential portion of the evaporator according to the second embodiment of the invention.
Figure 14:
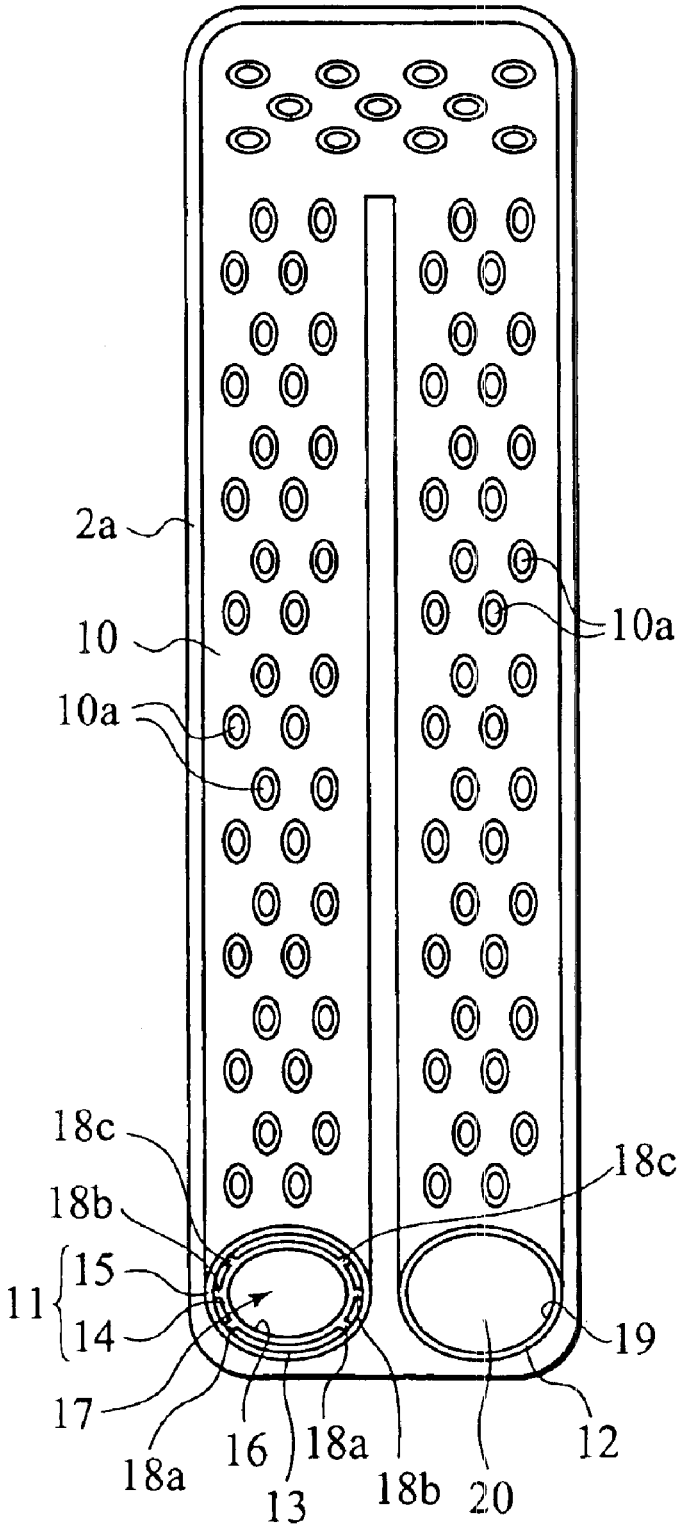
FIG. 14 shows an inner surface of a tube plate according to the second embodiment of the invention.
Figure 15:
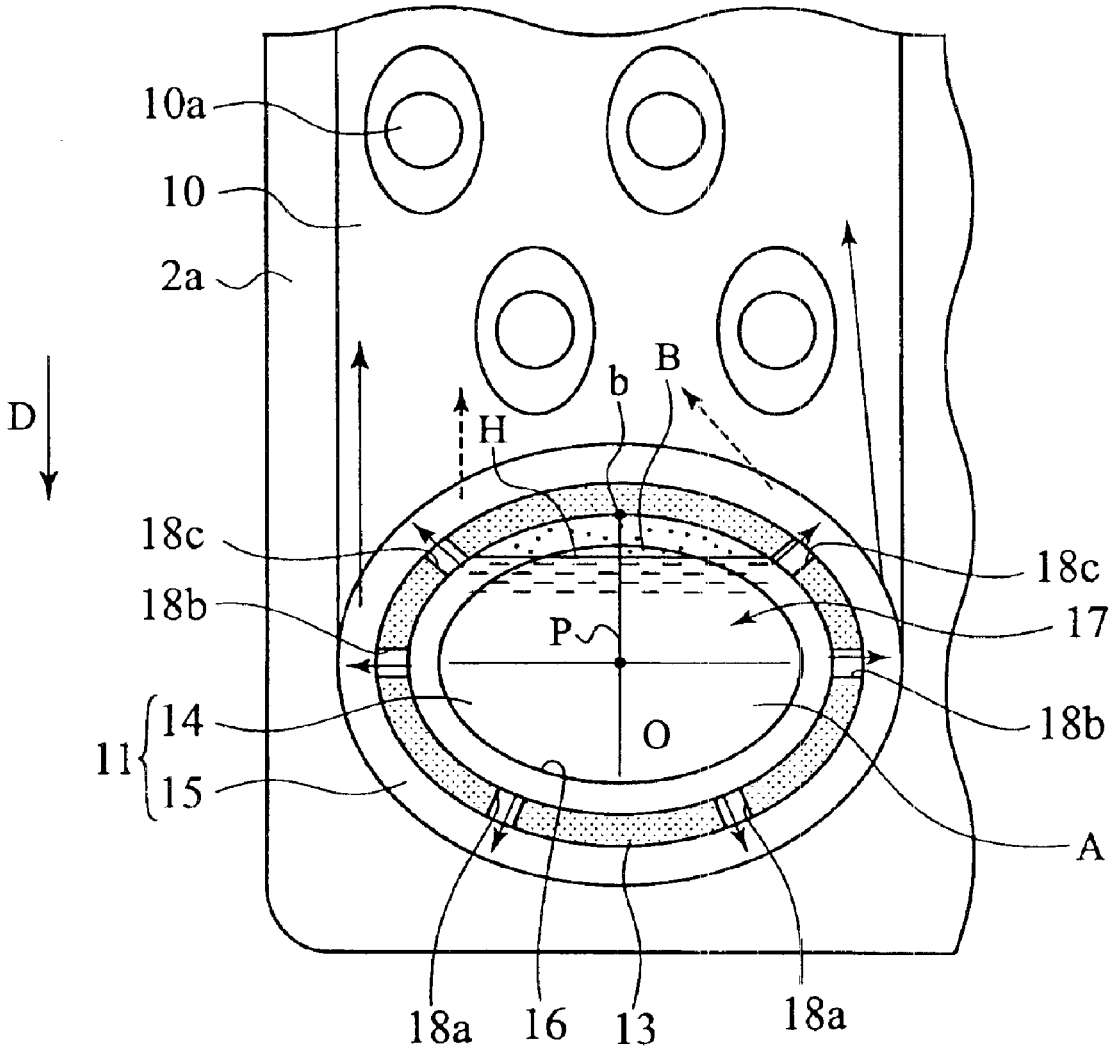
FIG. 15 is a magnified view of the inner surface of the inlet header chamber of the tube plate according to the second embodiment of the invention.

FIGS. 12 to 15 show a second embodiment of the present invention. FIG. 12 is a front view of an evaporator 1B, FIG. 13 is a sectional view of an essential portion of the evaporator 1B, FIG. 14 shows an inner surface of the tube plate 2*a*, and FIG. 15 is a magnified view of the inner surface of the inlet header chamber 11 of the tube plate 2*a*.

According to the evaporator 1B, as shown in FIGS. 12 and 13, positions of the inlet header chamber 11 and the outlet header chamber 12 are vertically reversed as compared with the first embodiment. That is, the inlet header chamber 11 and the outlet header chamber 12 are located below the refrigerant passage 10.

Like the first embodiment, the inlet header chamber 11 is partitioned by the partition wall 13 into the inner header chamber 14 and the outer header chamber 15. The partition wall 13 is provided at its three levels with the refrigerant through holes 18*a*, 18*b* and 18*c* which are laterally symmetric with respect to a center of the partition wall 13. The refrigerant through holes 18*a*, 18*b* and 18*c* are located in the same manner as that of the first embodiment. That is, as shown in FIGS. 14 and 15, the refrigerant through holes 18*a*, 18*b* and 18*c* are two upper holes 18*c*, two intermediate holes 18*b* and two lower holes 18*a*. Each upper hole 18*c* is located lower than an uppermost point b in the inner header chamber 14 and higher than the center position O of the inner header chamber 14. Each intermediate hole 18*b* is located at substantially the same height as the center position O of the inner header chamber 14. Each lower hole 18*a* is located lower than the center position O of the inner header chamber 14. It is preferable that a cross section area of the inner header chamber 14 located higher than the horizontal line H which intersects with the upper holes 18*c* is one-third of or less than the entire cross section area of the inner header chamber 14.

Since other configurations are the same as those of the first embodiment, the same constituent elements are designated with the same symbols, and explanation thereof will be omitted.

Flow of refrigerant in the evaporator 1B will be explained next. The refrigerant from the refrigerant inlet pipe 4 flows into the header inlet tank chamber 17, and flows into the refrigerant passage 10 from the inner header chamber 14 of each tube 2 through the through holes 18*a*, 18*b* and 18*c* and the outer header chamber 15. Then, the refrigerant flows through each U-shaped refrigerant passage 10. During this process, the refrigerant exchanges heat with fluid outside the refrigerant passage. The refrigerant flowing through the refrigerant passage 10 then flows into the header outlet tank chamber 20 from the outlet header chamber 12 of each tube 2, and merges with another refrigerant which has circulated another refrigerant passage 10 of another tube 2, and flows out from the refrigerant outlet pipe 5.

During the passage of the refrigerant, the refrigerant is supplied from the inner header chamber 14 of each tube 2 to the refrigerant passage 10 through the outer header chamber 15. This operation will be explained in detail. In the refrigerant flowing into the inner header chamber 14, a specific gravity of liquid phase refrigerant A is larger than that of gas phase refrigerant B is light. Thus, the liquid phase refrigerant A is stored in an entire lower region of the inner header chamber 14, and the gas phase refrigerant B is stored in the entire upper region of the inner header chamber 14. If a boundary surface between the gas phase refrigerant B and a liquid layer A becomes lower than the upper holes 18*c*, the gas phase refrigerant flows out into the respective outer header chambers 15 through the upper holes 18*c* of the tubes 2 only by the overflow. Therefore, even when the flow rate of the refrigerant is small, gas phase refrigerant flows out into the refrigerant passages 10 of the tubes 2 substantially equally. The liquid phase refrigerant A in the inner header chamber 14 flows out into the outer header chambers 15 mainly through the intermediate holes 18*b* and the lower holes 18*a*. Since the gas phase refrigerant B flows out from the inner header chamber 14 by the overflow, the liquid phase refrigerant A is not affected by flowing resistance and pressure variation of gas phase refrigerant B and thus, the height of an interface between the gas phase and liquid phase can be maintained even. Therefore, the refrigerant is equally distributed to the outer header chambers 15 of the tubes 2. Thus, the refrigerant can be distributed to the refrigerant passages 10 substantially equally irrespective of the flow rate of the refrigerant, and the heat exchange efficiency can be enhanced.

In this embodiment, the refrigerant through holes 18*a*, 18*b* and 18*c* include the upper holes 18*c* located lower than an uppermost point b in the inner header chamber 14 and higher than the center position O of the inner header chamber 14, the intermediate holes 18*b* located at substantially the same height as the center position O of the inner header chamber 14, and the lower holes 18*a* located lower than the center position O of the inner header chamber 14. Therefore, mainly the liquid phase refrigerant A flows out from the lower holes 18*a* and the intermediate holes 18*b*, and mainly the gas phase refrigerant B flows out from the upper holes 18*c*. As a result, the liquid phase refrigerant A is equally distributed to the refrigerant passages 10 almost without being affected by the pressure and variation of the pressure of the gas phase refrigerant B.

In this embodiment, the upper holes 18*c* are located at such positions that the cross section area of the inner header chamber 14 located higher than the horizontal line H which intersects with the upper holes 18*c* is one-third of the entire cross section area of the inner header chamber 14 or less than that. Therefore, one-third of gas phase refrigerant B is stored in the inner header chamber 14, and it can be expected that the gas phase refrigerant B flows out stably by the overflow.

In this embodiment, the refrigerant through holes 18*a*, 18*b* and 18*c* are located laterally symmetric with respect to the center of the inner header chamber 14. Therefore, the liquid phase refrigerant A and gas phase refrigerant B can flow out from left and right positions of the inner header chamber 14. Thus, the liquid phase refrigerant A and gas phase refrigerant B can smoothly flow out from the inner header chamber 14. It is possible to prevent generation of uneven pressure at left and right positions in the inner header chamber 14 and the outer header chamber 15.

According to this embodiment, among the refrigerant flowing into the inner header chamber, the liquid phase refrigerant is stored in the entire lower region in the inner header chamber and the gas phase refrigerant is stored in the entire upper region in the inner header chamber. If the position of the gas phase becomes lower than the upper refrigerant hole, the gas phase refrigerant flows out from the upper refrigerant holes of the tubes only by the overflow. Thus, even when the flow rate of the refrigerant is small, gas phase refrigerant flows out into the refrigerant passages of the tubes substantially equally. The liquid phase refrigerant in the inner header chamber flows out into the outer header chamber through the lower refrigerant holes. Since the gas phase refrigerant flows out from the inner header chamber by the overflow, the liquid level is equalized almost without being affected by drift of gas phase, and the liquid phase refrigerant is distributed to the outer header chambers of the tubes equally. Thus, the refrigerant can be distributed to the refrigerant passages substantially equally irrespective of the flow rate of the refrigerant, and the heat exchange efficiency can be enhanced.

Further, mainly the liquid phase refrigerant flows out from the lower holes and the intermediate holes, and mainly the gas phase refrigerant flows out from the upper holes. Thus, the liquid phase refrigerant is distributed to the refrigerant passages equally almost without being affected by dynamic pressure of gas phase.

Modified Embodiments

Figures 16A, 16B, 16C:
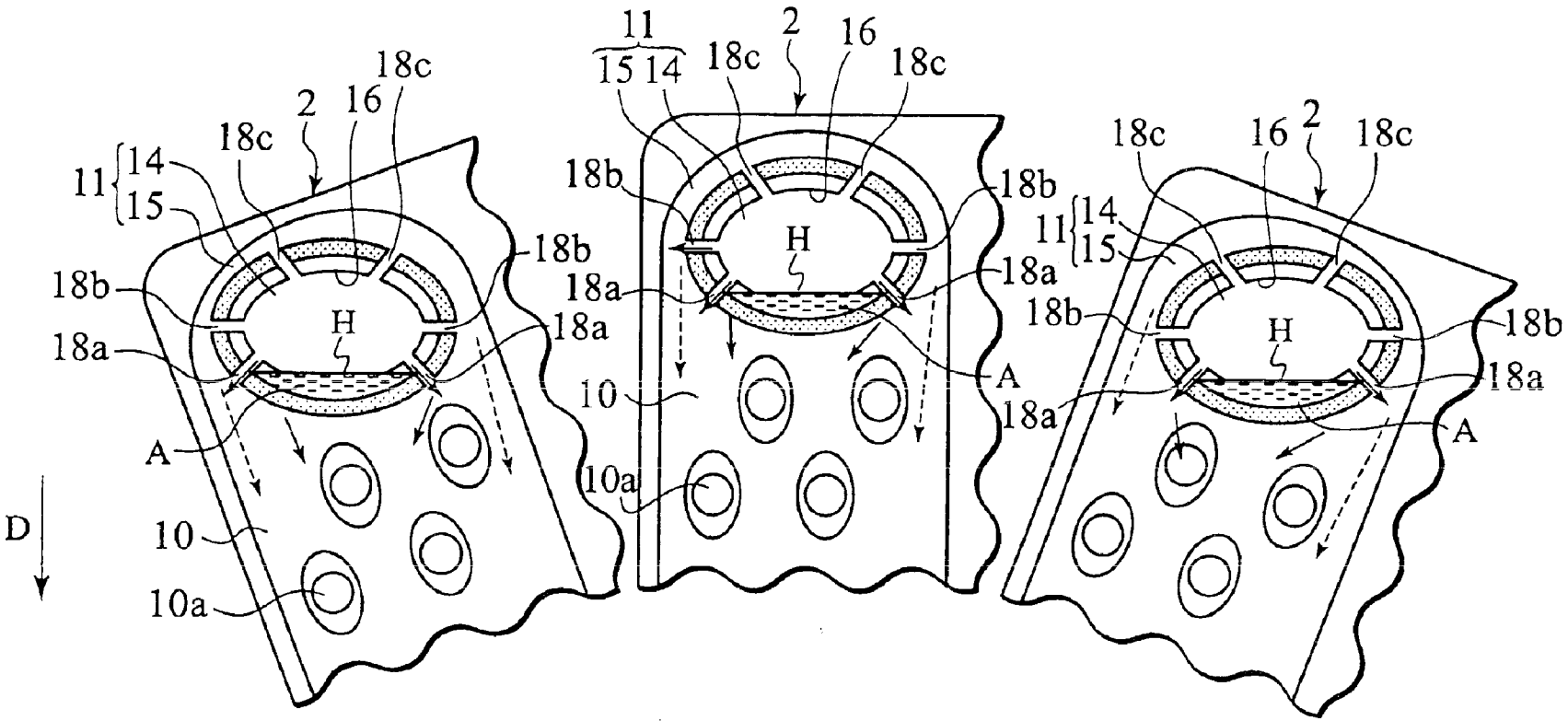

FIGS. 16A to 16C show a modification of the first embodiment. FIG. 16A shows an inner surface of an essential portion of the tube 2 which is inclined at an angle of −20°. FIG. 16B shows the inner surface of an essential portion of the tube 2 which is inclined at an angle of 0°. FIG. 16C shows the inner surface of an essential portion of the tube 2 which is inclined at an angle of +20°.

As shown in FIGS. 16A to 16C, the positions of the six refrigerant through holes 18*a*, 18*b* and 18*c* at three positions are changed in accordance with the inclination angle of the tube 2. As a result, the left and right through holes are disposed substantially in parallel to the horizontal line H.

With this configuration, the same amount of liquid phase refrigerant A can be stored in the inner header chamber 14 irrespective of the angle of the disposed heat exchanger.

If the same configuration is employed in the second embodiment, the same amount of gas phase refrigerant B can be stored in the inner header chamber 14 irrespective of the angle of the disposed heat exchanger.

Although the refrigerant through holes 18*a*, 18*b* and 18*c* are provided at three levels in each of the embodiments, the present invention is not limited to this configuration only if these through holes are provided at least at two levels. In the embodiments, preferably, total of six refrigerant holes are provided at three height positions. More preferably, total of eight or more refrigerant holes should be provided at four or more height positions. With this configuration, two refrigerant holes are used for discharging the liquid phase refrigerant A, six or more refrigerant holes are used for discharging the gas phase refrigerant B, and a ratio of the liquid phase refrigerant A and the gas phase refrigerant B can be satisfied.

Although the cross section of the inner header chamber 14 is substantially elliptic in the embodiments, the cross section shape is not limited, and circular, rectangular or triangular cross section may also be employed.

Although the refrigerant passage 10 in the tube 2 is U-shaped in the embodiments, the present invention is obviously applied to the refrigerant passage 10 with a straight shape or any other shapes.

This application claims benefit of priority under 35USC §119 to Japanese Patent Applications No. 2003-114217, filed on Apr. 18, 2003, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. An evaporator having a plurality of laminated tubes, a refrigerant passage formed in each tube, an inlet header chamber which is in communication with one end of the refrigerant passage, and an outlet header chamber which is in communication with the other end of the refrigerant passage, the evaporator comprising:

an inner header chamber defined in the inlet header chamber by a partition wall;

an outer header chamber defined by an outer periphery of the inner header chamber by the partition wall, the outer header chamber being in communication with the refrigerant passage; and a common refrigerant supplier formed by an assembly of the inner header chambers, wherein the refrigerant supplier stores refrigerant having substantially the same liquid level in all the inner header chambers.

2. The evaporator according to claim 1, further comprising a plurality of refrigerant through holes formed in the partition wall, the refrigerant through holes being formed at two levels, wherein the refrigerant which flows out from the refrigerant supplier is supplied to the refrigerant passages through the outer header chambers.

3. The evaporator according to claim 2, wherein the refrigerant supplier is disposed above the refrigerant passage.

4. The evaporator according to claim 3, wherein the refrigerant through holes are disposed higher than a lowermost position of the inner header chamber.

5. The evaporator according to claim 3, wherein the refrigerant through holes are disposed above and below a center position of the inner header chamber.

6. The evaporator according to claim 3, wherein the refrigerant through holes are lower holes located below the center position of the inner header chamber, intermediate holes located at substantially the same level as the center position, and upper holes located above the center position.

7. The evaporator according to claim 6, wherein the lower holes are provided at a liquid level at which a cross section area of the inner header chamber occupied by liquid phase refrigerant is one-third of the cross section area of the inner header chamber or less.

8. The evaporator according to claim 6, wherein the refrigerant through holes are provided on a one-pair by one-pair basis at locations opposed to each other at the same level.

9. The evaporator according to claim 2, wherein the refrigerant supplier is disposed below each refrigerant passage.

10. The evaporator according to claim 9, wherein the refrigerant through holes are located below an uppermost position of the inner header chamber.

11. The evaporator according to claim 9, wherein the refrigerant through holes are disposed above and below the center position of the inner header chamber.

12. The evaporator according to claim 9, wherein the refrigerant through holes are lower holes located below the center position of the inner header chamber, intermediate holes located at substantially the same level as the center position, and upper holes located above the center position.

13. The evaporator according to claim 12, wherein the refrigerant through holes are provided on a one-pair by one-pair basis at locations opposed to each other at the same level.

* * * * *